US007815515B1

(12) United States Patent
Hunt

(10) Patent No.: US 7,815,515 B1
(45) Date of Patent: Oct. 19, 2010

(54) GOLF PUTTER HAVING BAR AND SLOT ALIGNMENT SYSTEM

(76) Inventor: William Hunt, 96 Makena Rd., Kihei, HI (US) 96753

( * ) Notice: Subject to any disclaimer, the term of this patent is extended or adjusted under 35 U.S.C. 154(b) by 0 days.

(21) Appl. No.: 12/470,323

(22) Filed: May 21, 2009

(51) Int. Cl.
*A63B 69/36* (2006.01)
*A63B 53/04* (2006.01)

(52) U.S. Cl. ..... 473/251; 473/253; 473/254; 473/255; 473/340

(58) Field of Classification Search ..... 473/219–256, 473/340–341; D21/736–746
See application file for complete search history.

(56) References Cited

U.S. PATENT DOCUMENTS

| | | | | | |
|---|---|---|---|---|---|
| 3,880,430 | A * | 4/1975 | McCabe | 473/253 |
| D235,668 | S * | 7/1975 | Swash | D21/739 |
| 4,136,877 | A * | 1/1979 | Antonious | 473/254 |
| 4,343,472 | A * | 8/1982 | Hamilton | 473/240 |
| 4,986,544 | A * | 1/1991 | Benson | 473/254 |
| 5,538,249 | A * | 7/1996 | Benson | 473/254 |
| 5,921,868 | A * | 7/1999 | DiMartino | 473/254 |
| 6,062,986 | A * | 5/2000 | Kaise | 473/242 |
| 6,926,615 | B1 * | 8/2005 | Souza et al. | 473/251 |
| 7,052,409 | B2 * | 5/2006 | Goldsmith | 473/242 |
| 7,341,526 | B2 * | 3/2008 | McCarthy | 473/251 |
| 7,438,648 | B2 * | 10/2008 | Wahl et al. | 473/340 |
| 7,485,047 | B2 * | 2/2009 | Evans | 473/249 |
| D603,922 | S * | 11/2009 | Meier et al. | D21/759 |
| 7,611,419 | B2 * | 11/2009 | O'Neill | 473/242 |
| 2006/0128499 | A1 * | 6/2006 | Yamanaka et al. | 473/340 |
| 2007/0238550 | A1 * | 10/2007 | Tateno | 473/340 |
| 2009/0017933 | A1 * | 1/2009 | Stites et al. | 473/254 |
| 2009/0029798 | A1 * | 1/2009 | Stellander | 473/340 |

* cited by examiner

*Primary Examiner*—Sebastiano Passaniti
(74) *Attorney, Agent, or Firm*—Graybeal Jackson LLP; Thomas E. Loop

(57) ABSTRACT

Disclosed herein is a golf putter having an alignment means for aligning a golfer's line of sight directly over a golf ball and in line with a desired target. The putter head comprises a striking face and a rearwardly extending body portion. The body portion includes an upper section having an alignment bar protruding away from and perpendicular to the striking face and a lower section having an alignment slot extending away from and perpendicular to the striking face. The alignment bar and slot are centrally positioned and spaced apart from each other such that (i) the slot becomes obscured by the alignment bar when the golfer's line of sight is directly over the striking face and the golf ball at their point of contact, and (ii) the alignment bar and slot are in line with the desired target when the striking face strikes the golf ball.

5 Claims, 7 Drawing Sheets

GOLF PUTTER HAVING BAR AND SLOT ALIGNMENT SYSTEM

TECHNICAL FIELD

The present invention relates generally to golf clubs and, more specifically, to golf putters having integral alignment systems for aligning a golfer's line of sight directly over the putter club face and ball and in line with a desired target.

BACKGROUND OF THE INVENTION

Putting is a critical aspect of the game of golf. While each golfer tends to possess his own unique style of putting, some fundamentals are universally recognized as being essential to most successful putting techniques. For example, the putter face must strike the ball at a 90° angle to the intended direction of travel. A stance with the golfer's eyes directly over the putter face assists in striking the ball squarely and in line towards the cup. During the act of putting, a golfer relies on his own visual perceptions to insure that his stance positions the putter face perpendicular to the ground and in line with the flagstick (at the point of contact of the putter face with the golf ball).

A variety of putter heads have been developed over the years which assist the golfer in visually determining the proper position of the putter head with respect to the ball, target line, and putting surface. Some putter head designs focus on heel and toe weighting to counter off-center hits. Many putter heads have markings, lines, grooves, or other structures that assist the golfer in aligning the ball at the "sweet spot" of the striking face and aligning the striking face perpendicular to the target line.

Exemplary prior art golf putters that disclose putter heads having integral alignment systems for aligning a golfer's line of sight directly over the club face and ball and in line with a desired target include U.S. Pat. No. 7,341,526 to McCarthy (discloses a putter head having a pair of alignment pins of contrasting colors extending rearwardly away from and perpendicular to the putter face), U.S. Pat. No. 5,538,249 to Benson (discloses a putter head having a linear protrusion and a linear raised strip extending rearwardly away from and perpendicular to the putter face), and U.S. Pat. No. 3,880,430 to McCabe (discloses a putter head having linear indicia or markings at different elevations and perpendicular to the putter face). All of these golf putter alignment systems, however, do not allow visual perception of the ground through the putter head and, therefore, a golfer may not be entirely sure as to the elevational position of the bottom surface of the putter head relative to the ground.

Accordingly, and although advances have been made over the years with respect to golf putters, there is still a need in the art for new golf putters having alternative alignment systems for aligning a golfer's line of sight directly over the club face and in line with a desired target, and allowing a golfer to visually perceive the ground through the putter head. The present invention fulfills these needs and provides for further related advantages.

SUMMARY OF THE INVENTION

In brief, the present invention is directed to a golf putter having an alignment means for aligning a golfer's line of sight directly over a golf ball and in line with a desired target. The innovative golf putter includes an elongated shaft having a grip end and a distal end. A putter head is connected to the distal end of the shaft. The putter head comprises a substantially planar ball striking face and a body portion extending rearwardly away from the ball striking face. The body portion includes an upper section having an alignment bar protruding away from and perpendicular to the ball striking face and a lower section having an alignment slot extending away from and perpendicular to the ball striking face. The alignment bar and slot are centrally positioned within the body portion and spaced apart from each other such that (i) the slot becomes obscured by the alignment bar when the golfer's line of sight is directly over the ball striking face and the golf ball at their point of contact, and (ii) the alignment bar and slot are in line with the desired target when the ball striking face strikes the golf ball.

These and other aspects of the present invention will become more evident upon reference to the following detailed description and attached drawings.

BRIEF DESCRIPTION OF THE DRAWINGS

The drawings are intended to be illustrative and symbolic representations of certain exemplary embodiments of the present invention. For purposes of clarity, like reference numerals have been used to designate identical or like features throughout the several views of the drawings.

DETAILED DESCRIPTION OF THE INVENTION

Figure 1:
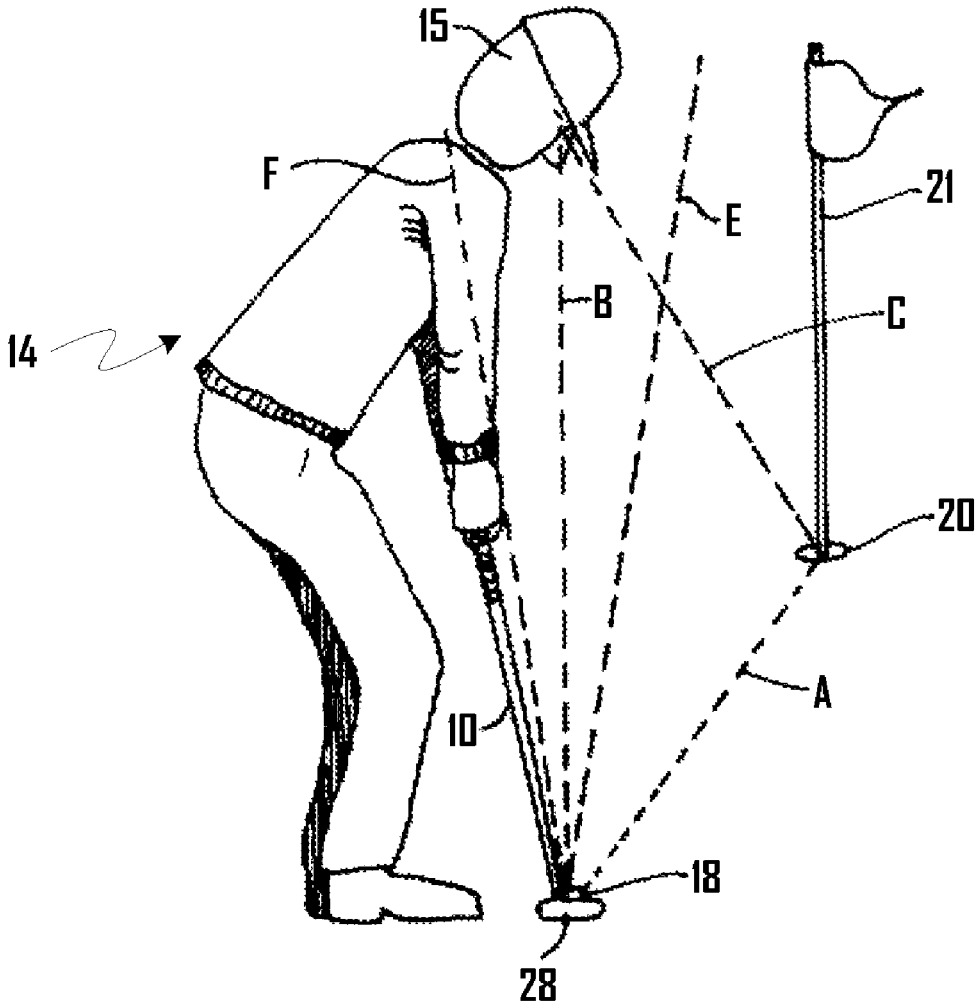
FIG. 1 is a schematic diagram illustrating how a golfer may utilize the present invention to properly position his head and line of sight relative to a putter face and ball and in line with a desired target.

Referring now to the drawings in which like reference numerals have been used to designate identical or like features, and more specifically to FIG. 1, a golfer 14 is diagrammatically represented as attempting to line his putter 10 up with the hole 20 in which the flagstick or pin 21 is located. One difficulty encountered by many golfers is being sure that their head 15 is in proper position above the ball 18, particularly considered in a plane which is at right angles to the intended line of travel. The golfer 14 is illustrated as employing a putter 10 having a putter head 28 which is to strike the ball 18 so as to knock the ball 18 into the cup or hole 20 in which the pin 21 is set. Assuming a perfectly flat surface, the golfer 14 would like to move the ball 18 along the dotted line A into the hole 20. Ideally, the golfer's head 15 should be directly above the putter face (hidden) and ball 18. An analog would be to properly align one's eye along the sights placed on the barrel of a rifle with the intended target. As shown in FIG. 1, the golfer's head 15 is properly above the putter face 30 and ball 18 when the imaginary lines B (from the golfer's head 15 to the ball 18 and striking fact face 30) and C (from the golfer's head 15 to the cup) form a triangle with line A, which triangle is in a vertical plane passing through the line A. If the golfer's head 15 should move to either of the lines indicated at F and E, then any triangle including one or the other of such lines, the line A, and a line to the hole 20, would define a triangle askew to that defined by A, B and C; the golfer 14 would not have an accurate alignment.

In view of the foregoing and with reference to FIGS. 2A-G, the present invention in a first embodiment is directed to a golf putter 110 having an alignment means 112 for aligning a golfer's line of sight directly over a golf ball 18 and in line with a desired target such as a hole 20. As shown, the golf putter 110 includes an elongated shaft 122 having a grip end 124 and a distal end 126. A putter head 128 is connected to the distal end 126 of the shaft 122. The putter head 128 comprises a substantially planar ball striking face 130 and a body portion 132 extending rearwardly away from the ball striking face 130. The body portion 132 includes an upper section having an alignment bar 136 protruding away from and perpendicular to the ball striking face 130 and a lower section 134 having an alignment slot 140 extending away from and perpendicular to the ball striking face 130.

Figure 2A:
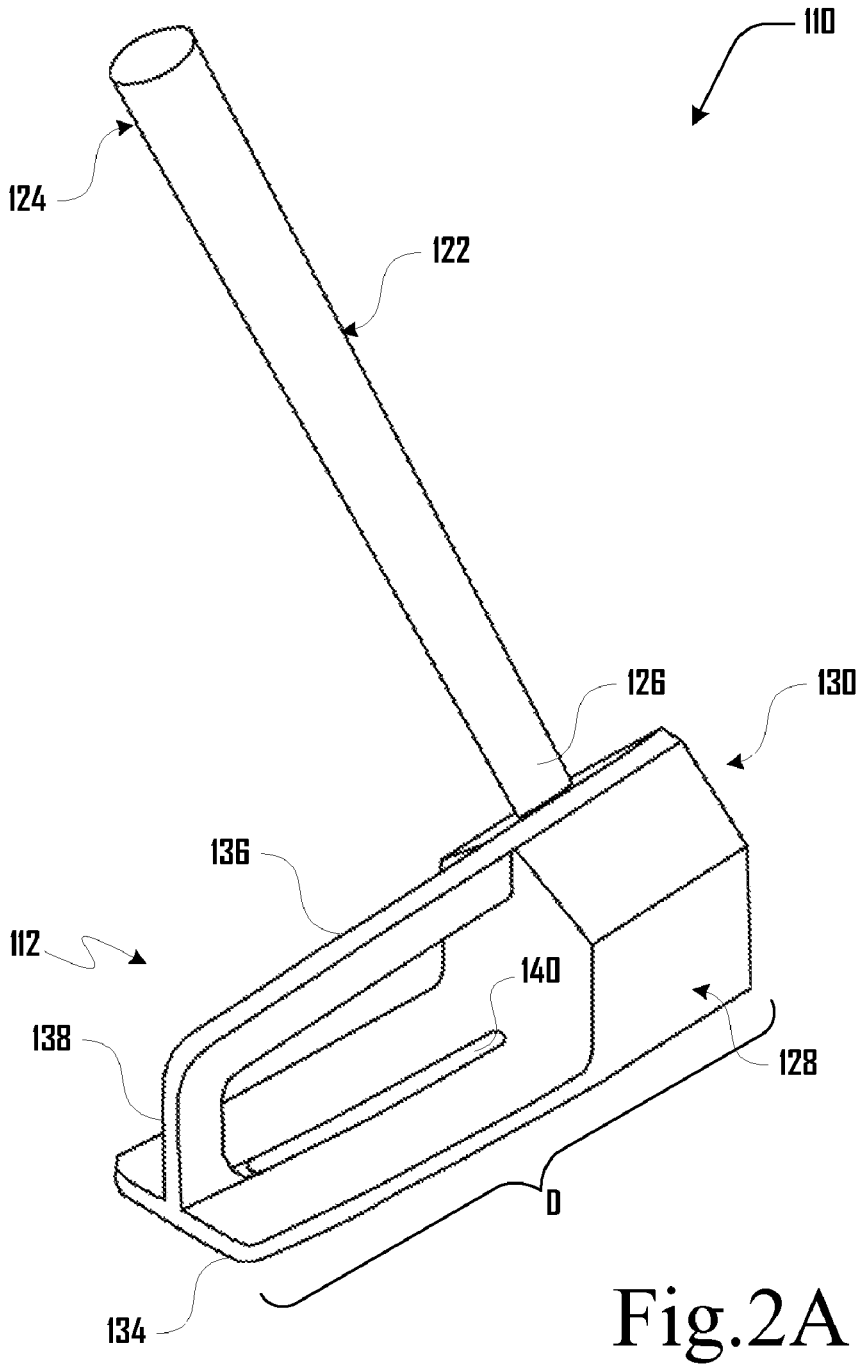
FIG. 2A shows a perspective view of a golf putter with a bar and slot alignment means in accordance with a first embodiment of the present invention.
Figure 2B:
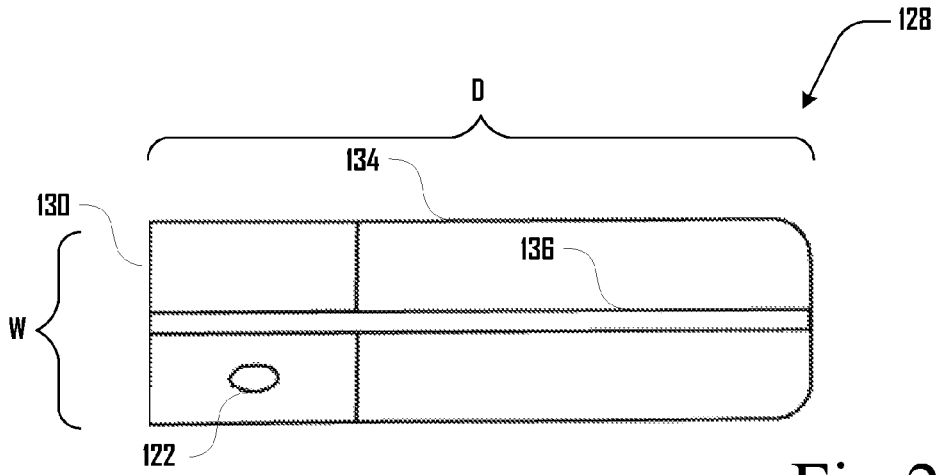
FIG. 2B is a top view of the putter head of the golf putter of FIG. 2A.
Figure 2C:
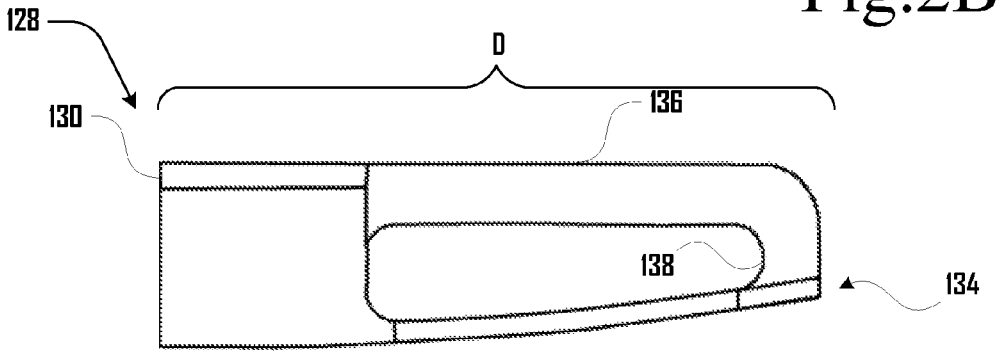
FIG. 2C is a side elevational view of the putter head of the golf putter of FIGS. 2A-B.
Figure 2D:
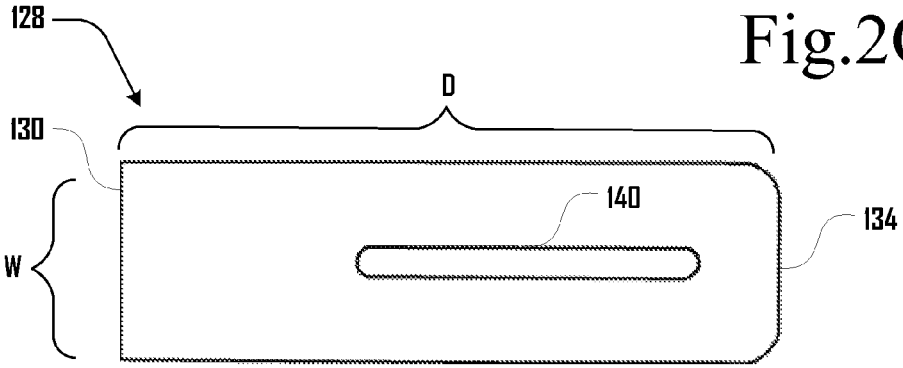
FIG. 2D is a bottom view of the putter head of the golf putter of FIGS. 2A-C.
Figure 2E:
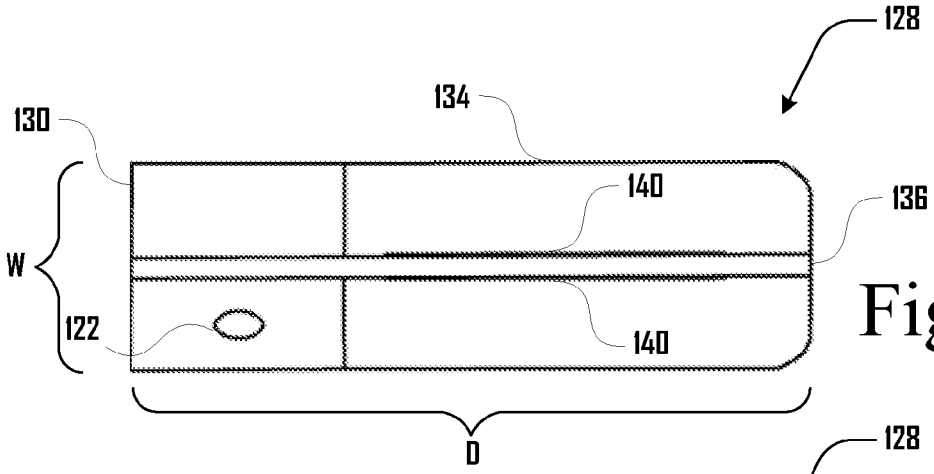
FIG. 2E is a top view of the putter head of the golf putter of FIGS. 2A-D (as shown, the slot on the bottom of the putter nearly disappears because the golfer's head is in the correct position).
Figure 2F:
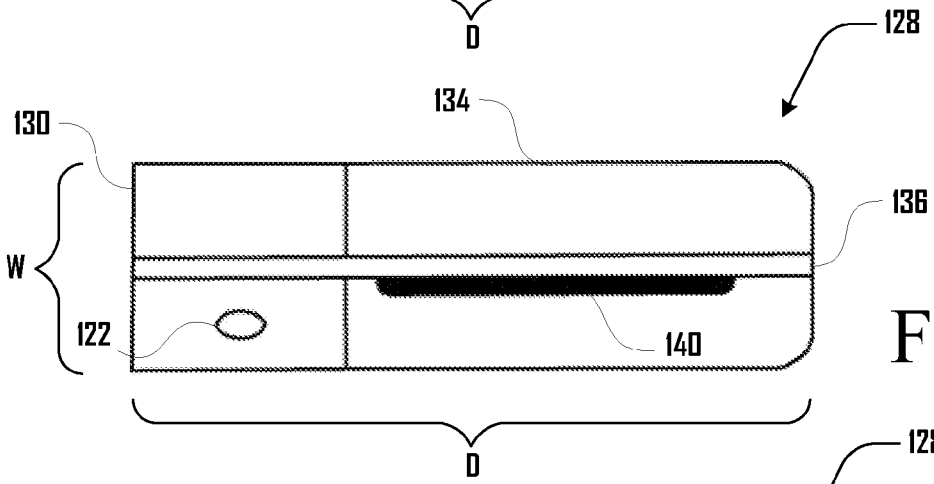
FIG. 2F is a top view of the putter head of the golf putter of FIGS. 2A-D (as shown, the slot on the bottom of the putter is not obscured because the putter is extended too far away from the golfer's body).
Figure 2G:
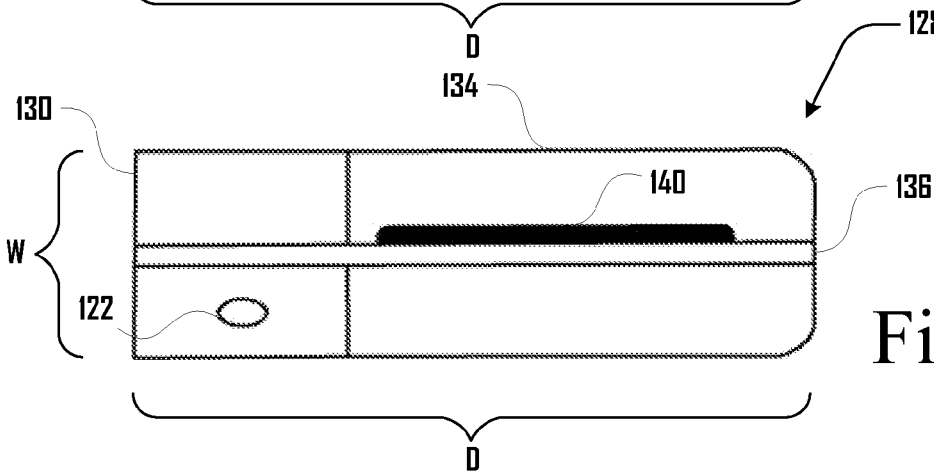
FIG. 2G is a top view of the putter head of the golf putter of FIGS. 2A-D (as shown, the slot on the bottom of the putter is not obscured because the putter is positioned too close to the golfer's body).

As best shown in FIGS. 2E-G, the alignment bar 136 and slot 140 are centrally positioned within the body portion 132 and spaced apart from each other such that (i) the slot 140 becomes obscured by the alignment bar 136 (as best shown in FIG. 2E) when the golfer's line of sight is directly over the ball striking face 130 and the golf ball 18 at their point of contact, and (ii) the alignment bar 136 and slot 140 are in line with the desired target when the ball striking face 130 strikes the golf ball 18. As shown, the putter head 28 has a width W (defined by the length of the ball striking face 130) and a depth D (defined by the length of the rearwardly extending body portion 132). In this first embodiment, the putter head's width W is less than the putter head's depth D.

In a second embodiment and with reference to FIGS. 3A-G, the present invention is directed to a golf putter 210 having an alignment means 212 for aligning a golfer's line of sight directly over a golf ball 18 and in line with a desired target, but wherein the putter head's width W is greater than or equal to the putter head's depth D (this geometry aids in keeping one's eye on the putter). As before, the golf putter 210 includes an elongated shaft 222 having a grip end 224 and a distal end 226. A putter head 228 is connected to the distal end 226 of the shaft 222. The putter head 228 comprises a substantially planar ball striking face 230 (which may include face grooves 248) and a body portion 232 extending rearwardly away from the ball striking face 230. The body portion 232 includes an upper section having an alignment bar 236 protruding away from and perpendicular to the ball striking face 230 and a lower section 234 having an alignment slot 240 extending away from and perpendicular to the ball striking face 230.

Figure 3A:
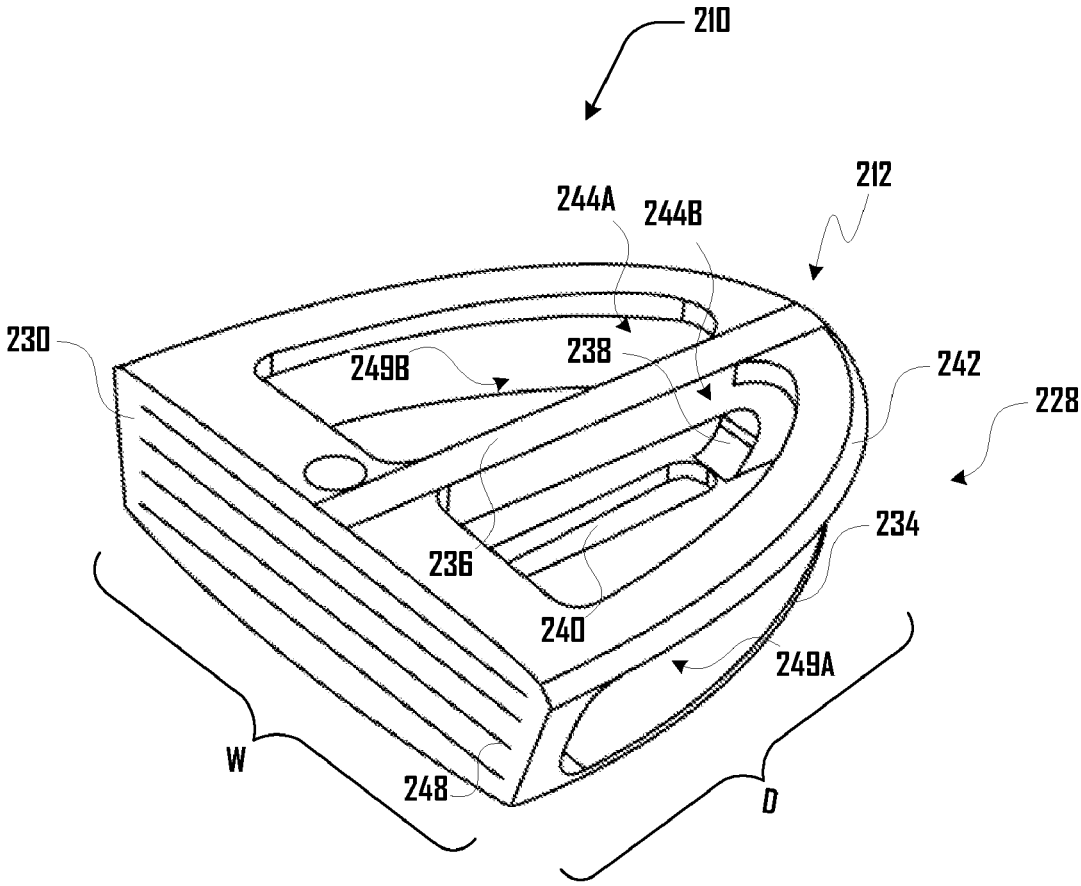
FIG. 3A shows a perspective view of a golf putter with a bar and slot alignment means in accordance with a second embodiment of the present invention.
Figure 3B:
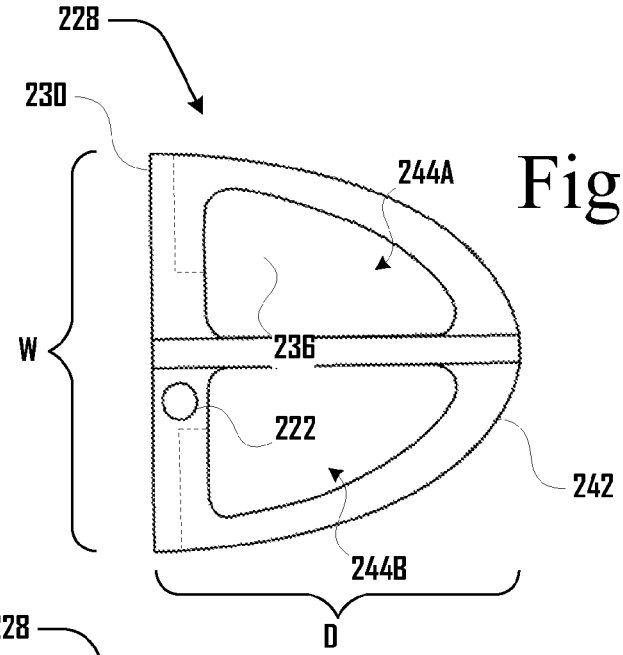
FIG. 3B is a top view of the putter head of the golf putter of FIG. 3A.
Figure 3C:
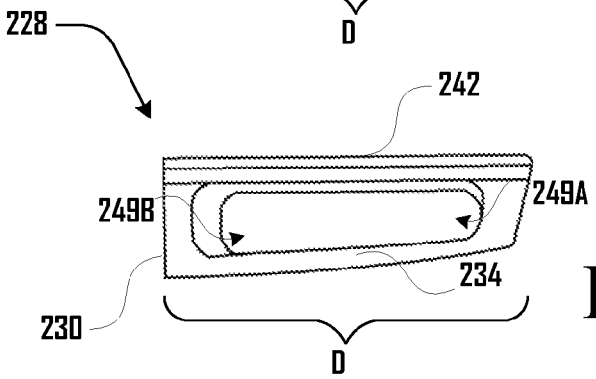
FIG. 3C is a side elevational view of the putter head of the golf putter of FIGS. 3A-B.
Figure 3D:
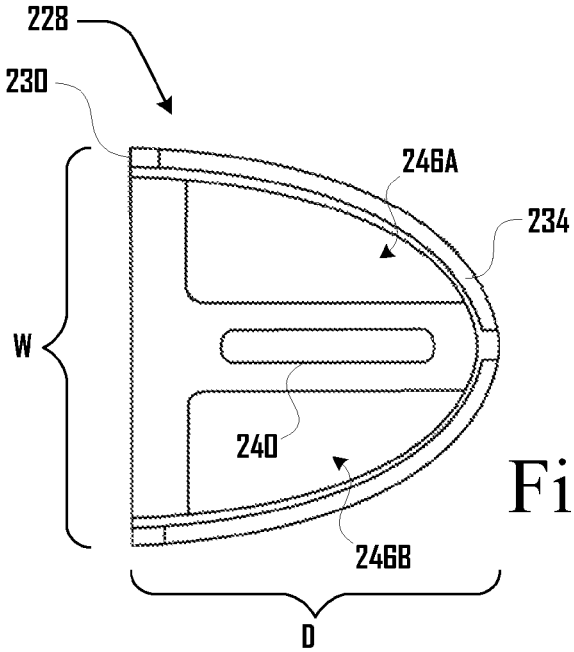
FIG. 3D is a bottom view of the putter head of the golf putter of FIGS. 3A-C.
Figure 3E:
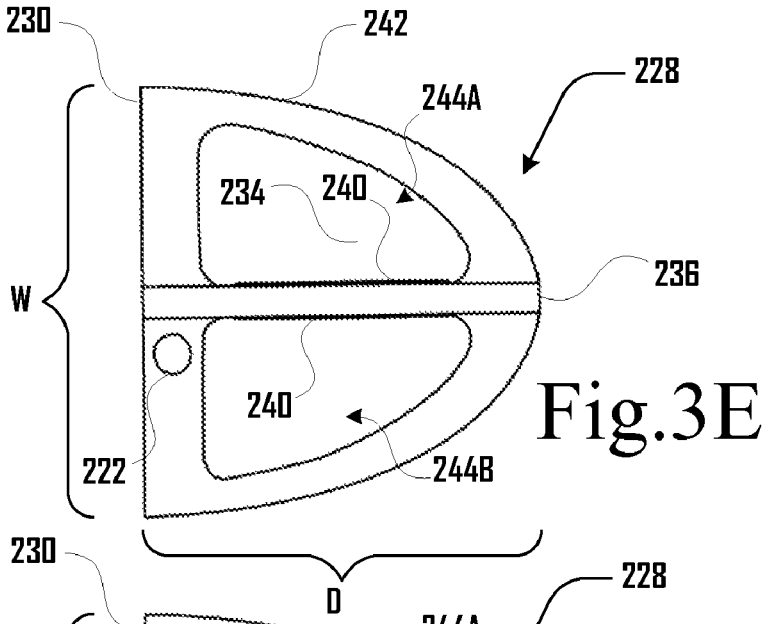
FIG. 3E is a top view of the putter head of the golf putter of FIGS. 3A-D (as shown, the slot on the bottom of the putter nearly disappears because the golfer's head is in the correct position).
Figure 3F:
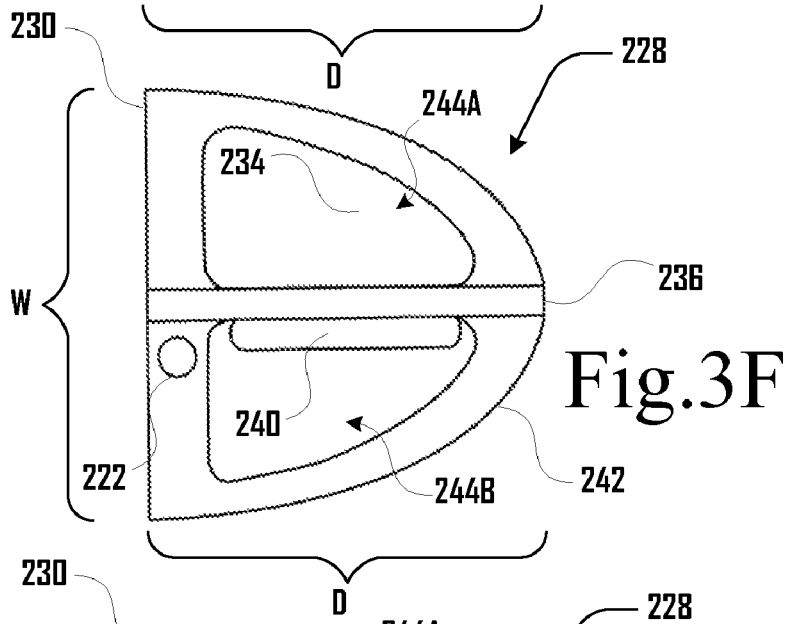
FIG. 3F is a top view of the putter head of the golf putter of FIGS. 3A-D (as shown, the slot on the bottom of the putter is not obscured because the putter is extended too far away from the golfer's body).
Figure 3G:
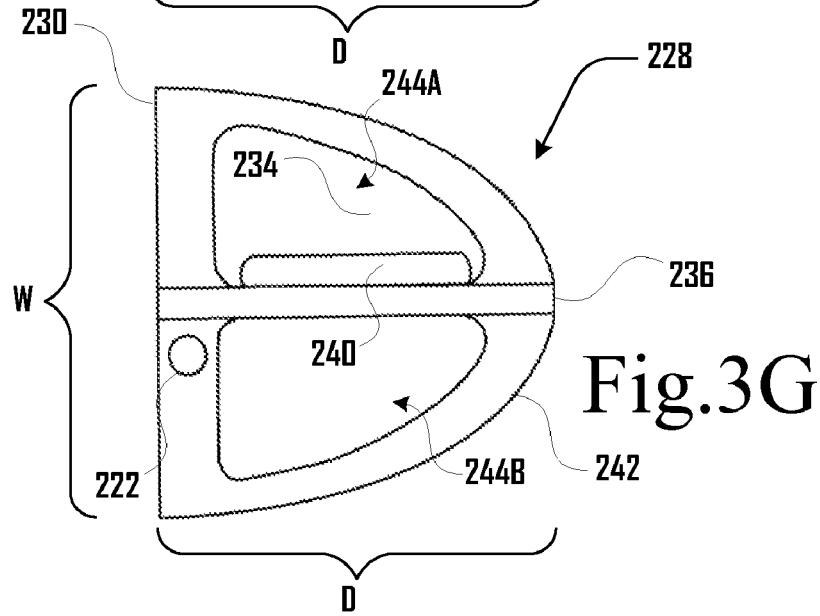
FIG. 3G is a top view of the putter head of the golf putter of FIGS. 2A-D (as shown, the slot on the bottom of the putter is not obscured because the putter is positioned too close to the golfer's body).

As best shown in FIGS. 3E-G, the alignment bar 236 and slot 240 are centrally positioned within the body portion 232 and spaced apart from each other such that (i) the slot 240 becomes obscured by the alignment bar 236 (as best shown in FIG. 3E) when the golfer's line of sight is directly over the ball striking face 230 and the golf ball 18 at their point of contact, and (ii) the alignment bar 236 and slot 240 are in line with the desired target when the ball striking face 230 strikes the golf ball 18.

The putter head 228 further comprises an upper arcuate support rim 242A that integrally connects the upper side edges of the ball striking face 230 with a rear portion of the alignment bar 236. The upper arcuate support rim 242A may be in a semi-oval shape and define a pair of top apertures 244A, 244B that are laterally positioned on either side of the alignment bar 236. Additionally, a lower arcuate support rim 242B integrally connects the lower side edges of the ball striking face 230 with a rear portion of the lower section 234. The lower arcuate support rim 242B may also be in a semi-oval shape and define a pair of bottom apertures 246A, 246B that are laterally positioned on either side of the lower section 234. In a preferred embodiment and as best shown in FIG. 3C, the upper and lower arcuate support rim 242A, 242B may define a pair of side apertures 249A, 249B. However, in some embodiments, as best shown in FIG. 3A, the pair of side apertures 249A, 249B may be absent.

The putter shaft 222 may be made of metal, wood, or a composite such as, for example, carbon fiber. The putter head 228 may be made of a metal such as, for example, aluminum.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing description, and all changes that come within the meaning and range of equivalency of the claims are to be embraced within their scope.

What is claimed is:

1. A golf putter having an alignment means for aligning a golfer's line of sight directly over a golf ball and in line with a desired target, comprising:

a shaft having a grip end and a distal end; and a putter head connected to the distal end of the shaft, the putter head comprising a substantially planar ball striking face and a body portion extending rearwardly away from the ball striking face, the body portion including an upper section having an alignment bar protruding away from and perpendicular to the ball striking face and a lower section having an alignment slot extending away from and perpendicular to the ball striking face, an upper arcuate support rim integrally connecting the upper side edges of the ball striking face with a rear portion of the alignment bar, the upper arcuate support rim being in the shape of a semi-oval and defining a pair of top apertures laterally positioned on either side of the centrally positioned alignment bar, the alignment bar and slot being centrally positioned within the body portion and spaced apart from each other such that (i) the slot becomes obscured by the alignment bar when the golfer's line of sight is directly over the ball striking face and the golf ball at their point of contact, and (ii) the alignment bar and slot are in line with the desired target when the ball striking face strikes the golf ball.

2. The golf putter of claim 1, further comprising a lower arcuate support rim integrally connecting the lower side edges of the ball striking face with a rear portion of the alignment slot, the lower arcuate support rim being in the shape of a semi-oval and defining a pair of bottom apertures laterally positioned on either side of the centrally positioned alignment slot.

3. The golf putter of claim 2 wherein the upper and lower arcuate support rims define a side aperture that extends through the body portion of the putter head and between the spaced apart alignment bar and slot.

4. The golf putter of claim 1 wherein the shaft is parallel to the ball striking face and perpendicular to the spaced apart alignment bar and slot.

5. The golf putter of claim 1 wherein the width of the ball striking face is greater than or equal to the depth of the body portion.

* * * * *